United States Patent [19]

Cuscino et al.

[11] Patent Number: 4,552,292

[45] Date of Patent: Nov. 12, 1985

[54] HEAT EXCHANGER

[75] Inventors: Richard T. Cuscino, Andover; Lester H. Lee, Braintree; Melvin A. Prohl, Boxford; David R. Skinner, Georgetown; Thomas F. Taylor, Salem, all of Mass.

[73] Assignee: General Electric Company, Lynn, Mass.

[21] Appl. No.: 440,800

[22] Filed: Nov. 12, 1982

[51] Int. Cl.[4] ..... B23P 15/26

[52] U.S. Cl. ..... 228/183; 165/162; 29/157.3 R

[58] Field of Search ..... 228/183, 184; 165/159, 165/162, 172; 122/510; 29/157.3 R, 157.3 B, 157.3 C, 157.3 A

[56] References Cited

U.S. PATENT DOCUMENTS

| | | | |
|---|---|---|---|
| 1,913,175 | 6/1933 | Summers | 29/157.3 B |
| 1,955,837 | 4/1934 | Scholl | 29/157.3 B |
| 2,038,912 | 4/1936 | Summers | 29/157.3 B |
| 2,092,170 | 9/1937 | Kritzer et al. | 29/157.3 B |
| 2,256,993 | 9/1941 | Van Vleet | 165/159 |
| 2,672,324 | 3/1954 | Weiss | 29/157.3 B |
| 3,137,638 | 6/1964 | Kumpf et al. | 165/172 |
| 3,163,208 | 12/1964 | Cuzzone et al. | 165/172 |
| 3,267,914 | 8/1966 | Connell | 122/510 |
| 3,295,598 | 1/1967 | Metzger | 29/157.3 R |
| 3,344,855 | 10/1967 | Clark | 165/159 |
| 3,366,172 | 1/1968 | Doroszloi | 165/172 |
| 3,820,594 | 6/1974 | Ritland et al. | 165/162 |
| 4,048,834 | 9/1977 | Durbin et al. | 29/157.3 A |
| 4,105,067 | 8/1978 | Bovagne | 228/183 |
| 4,149,591 | 4/1979 | Albertsen | 29/157.3 R |
| 4,236,575 | 12/1980 | Raseley et al. | 165/162 |
| 4,253,516 | 3/1981 | Giardina | 165/78 |
| 4,325,171 | 4/1982 | Nobles | 165/159 |
| 4,344,480 | 8/1982 | Boyer et al. | 165/162 |
| 4,433,721 | 2/1984 | Biaggi | 165/162 |

*Primary Examiner*—Kenneth J. Ramsey
*Assistant Examiner*—M. Jordan
*Attorney, Agent, or Firm*—James W. Mitchell

[57] ABSTRACT

A heat exchanger includes a number of fluid carrying tubes disposed in a hot gas flow path. One arrangement of heat exchanger tubes includes a plurality of finned serpentine tubes parallel to one another and connected to an inlet header and an outlet header. The present invention discloses a support for a serpentine tube arrangement and a method of construction for a non-contact heat exchanger.

5 Claims, 11 Drawing Figures

BOX ASSEMBLY

HEAT EXCHANGER

BACKGROUND OF THE INVENTION

This invention relates, in general, to heat exchangers and methods of constructing heat exchangers; and, in particular, this invention is useful in the field of non-contact heat recovery steam generators.

Heat recovery steam generators are non-contact type heat exchangers which include fluid carrying tubes disposed in a hot gas path. One example of such a device is shown in U.S. Pat. No. 4,262,705 to Skinner et al. assigned to the assignee of the present invention. Such an arrangement is sometimes referred to as a tube and plate construction because the fluid carrying tubes are supported by a plate having tube carrying holes formed through the plate. Heat recovery steam generators are useful in combined cycle power plants such as that shown in U.S. Pat. No. 4,316,435 to Nagamatsu et al. also assigned to the present assignee. In the Nagamatsu et al. patent a "U" tube construction is shown which comprises inlet and outlet pipes each connected to its respective complement pipe by a single "U" shaped return bend. There is another type of tube arrangement which utilizes serpentine tubes, as hereinafter described which include a number of straight pipes interconnected in series flow by a plurality of return bends. A serpentine arrangement of tubes utilized in combination with a tube support plate requires that the return bends be welded to the straight pipes after the straight pipes have been inserted through the tube plate holes. This results in less than desirable weld fabrication and test conditions while increasing the fabrication costs.

SUMMARY OF THE INVENTION

The present invention is a non-contact heat exchanger of the type which includes a plurality of serpentine tubes which are hung from several support beams by a number of tube hanger straps which are welded together. The tube hanger straps welded together form a tube support sheet section which is later hung from a support beam. Several tube support sheet sections are welded together to form a tube support sheet of which there are several spaced apart in the heat exchanger box. In the method of assembly for the present invention, the serpentine tube is completely formed, welded, and tested prior to its assembly with the tube hanger straps thus permitting bench welding operations and obviating local welding within the confined volume of the heat exchanger box.

OBJECTS OF THE INVENTION

It is an object of the invention to provide a heat exchanger design which includes an improved tube support structure.

It is another object of the invention to provide a method of constructing a heat exchanger wherein the fluid carrying tubes may be prefabricated and tested prior to assembly with the tube supports.

The novel features believed characteristic of the present invention are set forth in the appended claims. The invention itself, however, together with further objects and advantages thereof may best be understood with reference to the following description taken in connecticn with the drawing.

DETAILED DESCRIPTION OF THE INVENTION

Figure 1:
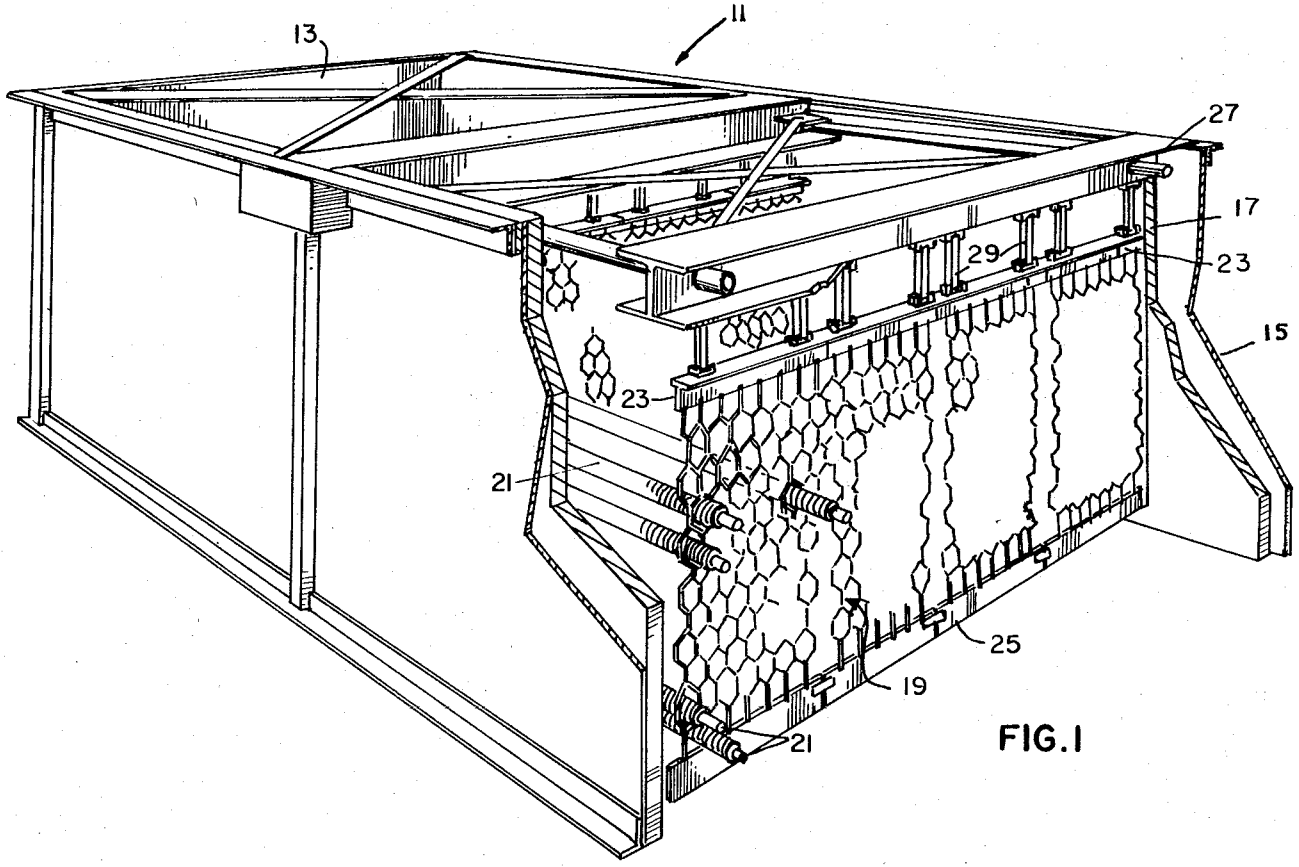
FIG. 1 is an isometric cutaway drawing of a heat exchanger showing several assembled tube support sheets.

This invention relates to non-contact heat exchangers of which one example is a heat recovery steam generator. The intent is to describe a device which channels hot gases past heat exchanger tubes which are disposed across the hot gas path or duct. The heat recovery steam generator may be comprised of multiple boxes including an economizer, an evaporator and a superheater. These boxes are by no means identical to one another but one representative heat exchanger box 11 is shown in FIG. 1. The heat exchanger box is comprised of end walls 13 (only one shown) and sidewalls 15. The entire walled portion of the box is lined with thermal insulation 17. The heat exchanger box further includes a plurality of tube support sheets or assembled hanger strap means 19 which provide support for heat exchanger tubes 21 only a sample of which are shown. Each tube support sheet is terminated and aligned at each end by upper and lower plate members 23 and 25 respectively. The upper plate members are supported from a beam 27 by means of pivotal links 29. The beams are then supported by structural members associated with the box sidewalls. The tube support sheets are preferably constructed in a honeycomb configuration which allows each serpentine tube row to be staggered relative to adjacent rows on each side. This configuration promotes better heat transfer and gas flow characteristics.

Figure 2:
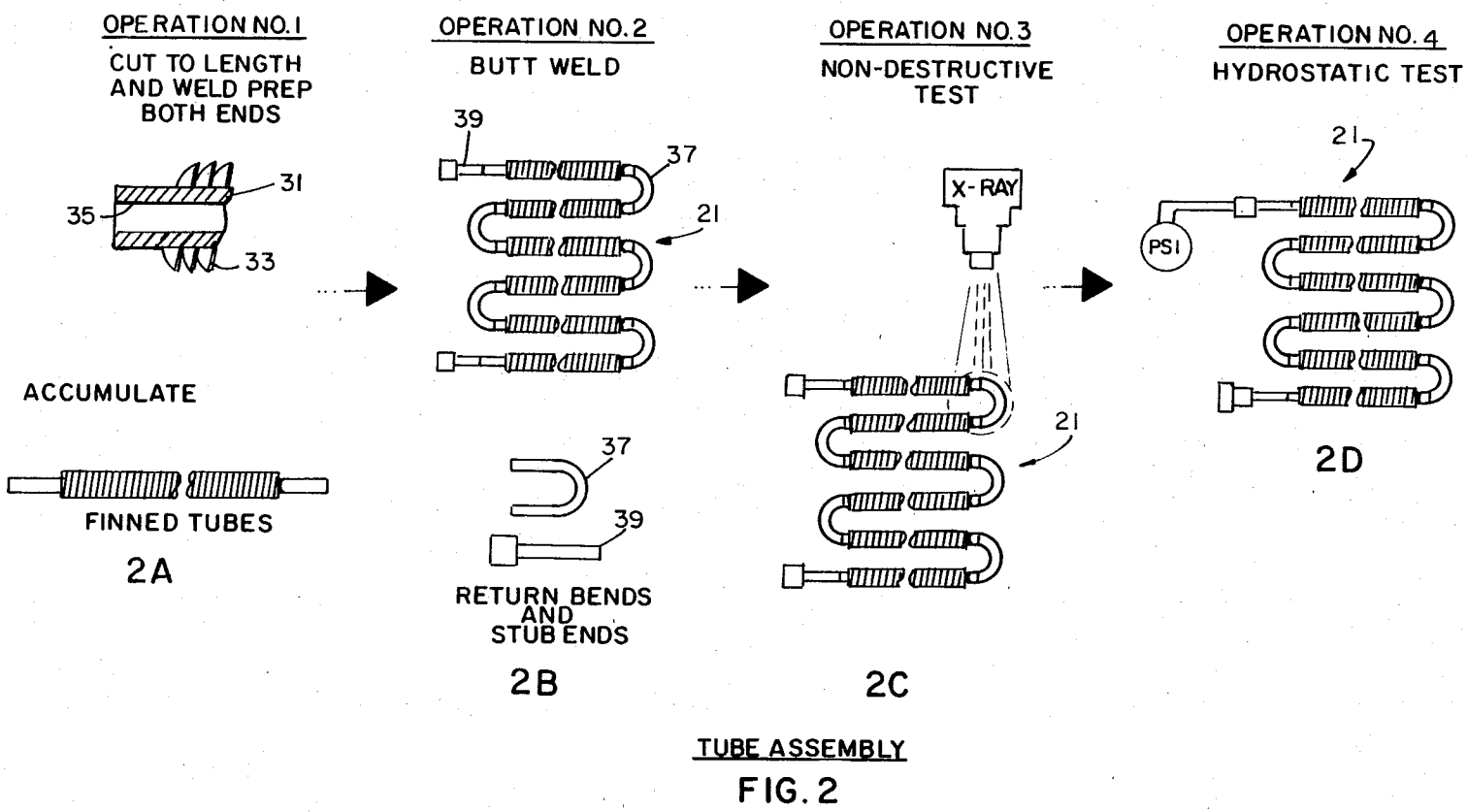
FIG. 2 is a manufacturing sequence drawing including steps 2A through 2D indicating the method of forming a serpentine tube prior to assembly with a tube support sheet section.

Referring now to FIG. 2, one preferred embodiment of the present invention includes the support of serpentine tubes. Serpentine tubes include a mandrel 31 and fin elements 33. The mandrel includes a hollow axial bore 35 which carries the tube side fluid to be heated. For convenience, this portion of finned tubing may be referred to as straight pipe.

Each straight pipe includes at either end a return bend 37 or a stub end 39. Hence the serpentine tube is comprised of at least a stub inlet end, a straight pipe, a return bend, a second straight pipe, and a stub outlet end in series flow configuration. More than likely, there will be several straight pipes interconnected by return bends and terminated at opposite ends by stub ends. The parts heretofore described are butt welded together to form a serpentine tube. The assembly operations can be traced in accordance with steps 2A through 2D shown in FIG. 2 which may be described as forming a finned tube; adding stub ends and return bends; testing non-destructively the weld seams and testing hydrostatically the integrity of the serpertine tube. A significant advantage of the present method and apparatus is that the foregoing steps may be carried out away from the confines of the heat exchanger box.

Figure 3:
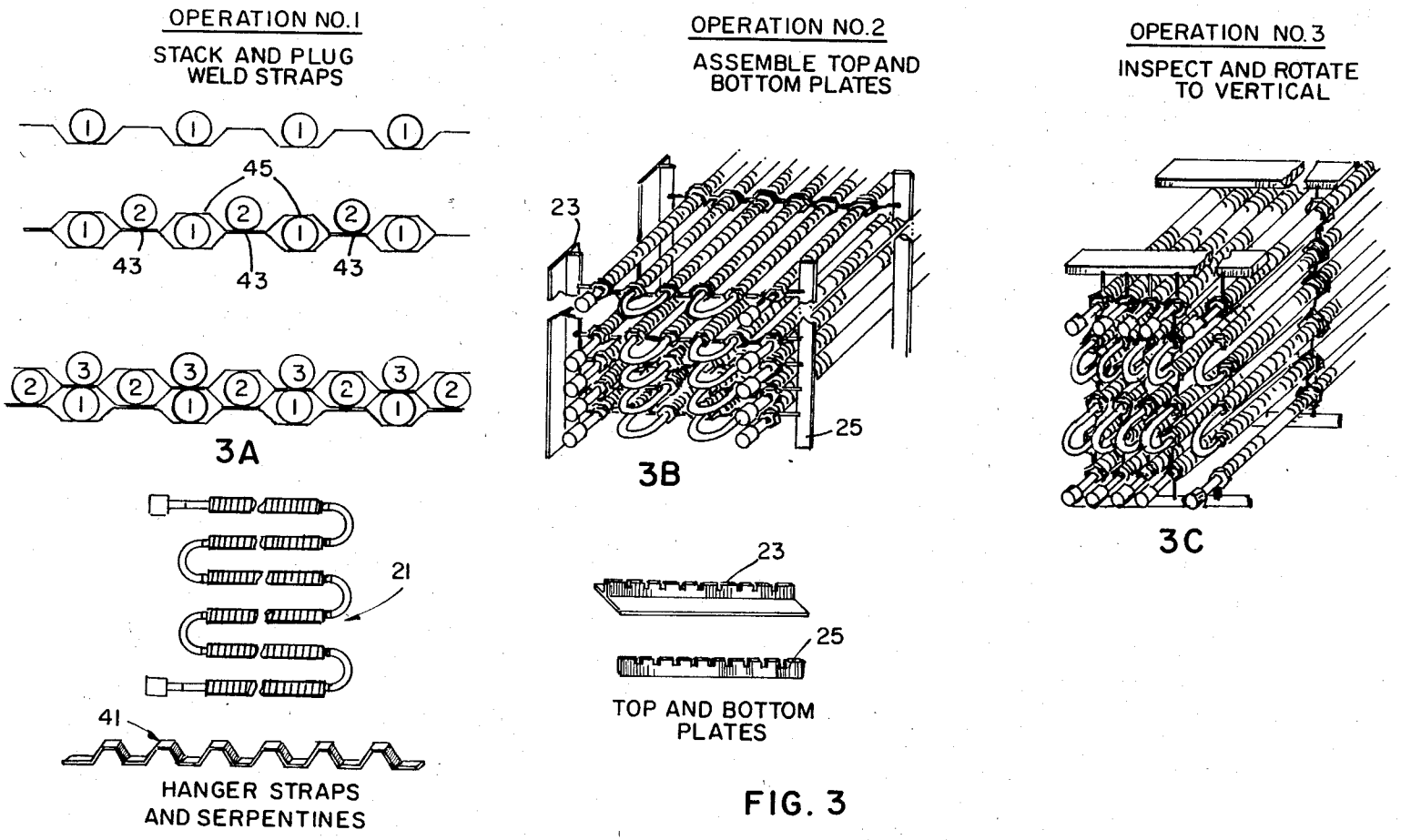
FIG. 3 is a manufacturing sequence drawing including steps 3A through 3C indicating the method and construction of the tubes and tube support sheet sections and modules.

FIG. 3 shows the formation of a tube module and the combination of the tube support sheet sections and fluid carrying tubes. FIG. 3A entitled Operation 1 is a stack and weld operation. A pre-assembled serpentine tube 21 is laid upon a hanger strap member 41 and an additional hanger strap member is laid upon the serpentine tube and thereafter is aligned with the first hanger strap member so that convergent parts 43 may be plug welded to one another whereas opposite divergent parts 45 form passageways for the tubes. In viewing FIG. 3A, the stacking operation comprises the steps of placing a first preformed serpentine tube 1 onto a first tube support strap and plug welding a second tube support strap to the first tube support strap at convergent parts. Adding a second serpentine tube 2 onto the second tube support strap and plug welding a third tube support strap to the second tube support strap at convergent parts and adding a third serpentine tube 3, etc. Fully assembled adjacent convergent and divergent parts are welded together to form a honeycomb structure comprising a tube support sheet section. FIG. 3B, operation No. 2, shows the stacking and welding operation complete in the formation of a tube module and furthermore shows the upper plate member 23 and the lower plate member 25 welded to each tube support sheet section (only two shown). Once the tube module is assembled by positioning several tube support sheet sections, the module is rotated ninety degrees for assembly within the heat exchanger box as is shown in step 3C. The tube support assembly operation comprises the steps of alternately stacking hanger strap members and serpentine tubes to form a tube support sheet section and module welding upper and lower plates to each tube support sheet section and rotating the tube module for assembly into the heat exchanger box. Adjacent tube support sections in the same plane are welded together, to form a tube support sheet, at the upper and lower plate members as indicated by the tabs shown in Figure 1 on the lower plate member. Thus the formation of a tube support sheet section and module includes the alternate stacking and welding operation of tube hanger straps and prefabricated serpentine tubes. Upper and lower plate members are added to each tube support sheet section. The module is rotated and hung from a support beam and adjacent plate members are welded together to secure and maintain a tube support sheet of which there are several.

Figure 4:
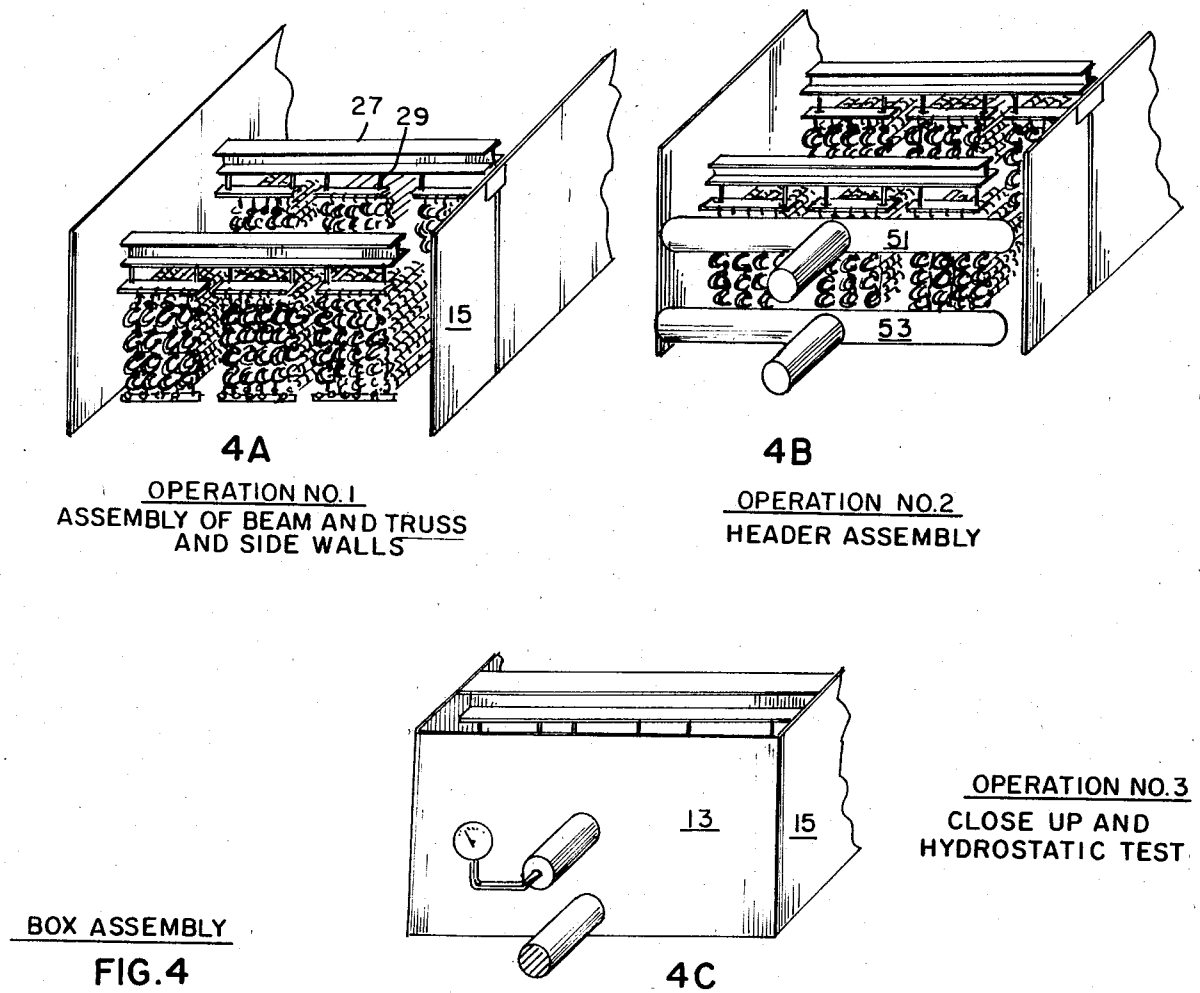
FIG. 4 is a manufacturing sequence drawing including steps 4A through 4C indicating the method of heat exchanger box assembly.

FIG. 4 shows the completed fabrication of the heat exchanger box or the box assembly sequence including the assembled tube support sheets and tubes to the box sidewalls 15 through the support beams 27 and pivot links 29, shown in FIGS. 1 and 4A. An inlet header 51 and an outlet header 53 are welded to the inlet and outlet stub members as shown in step 4B and finally the box is closed up by means of end wall 13 and prepared for an additional hydrostatic test as seen in step 4C.

Thus the finishing steps to the operation are mounting the tube support sheet and tube modules to the box structure; welding the inlet and outlet headers to the tube stubs and closing the box to contain the tubes, tube support sheets and headers.

While there is shown what is considered to be the preferred embodiment of the invention, it is recognized that other modifications may be made therein, and it is intended to cover all such modifications as fall within the true spirit and scope of the invention.

What we claim is:

1. A method of making a heat exchanger box of the type comprising a plurality of individual fluid carrying serpentine tubes each connected to a common inlet header and a common outlet header; the serpentine tubes being collectively supported from support beams as a plurality of tube modules in the heat exchanger box by a plurality of tube support sheets including convergent-divergent tube hanger straps; the method comprising the steps of:

prefabricating each serpentine tube from inlet to outlet prior to assembly into a tube module;

alternately stacking the serpentine tubes with tube hanger straps to form a plurality of tube support sheet sections and a tube module;

hanging a plurality of tube modules from a plurality of support beams; and, joining adjacent individual tube support sheet sections aligned in the same plane to form a plurality of tube support sheets.

2. The method recited in claim 1 wherein the stacking step further comprises the steps of:

laying horizontally a first hanger strap;

laying horizontally a first prefabricated tube so that it is aligned with divergent sections of the first hanger strap;

welding a second hanger strap to the first hanger strap at convergent portions and sandwiching said prefabricated serpentine tube between divergent sections; and, adding additional tubes and straps in alternating sequence to form each tube support sheet section.

3. The method recited in claim 2 further comprising the step of:

attaching upper and lower plate members to the tube hanger straps of each tube support sheet section to complete the formation of a tube support sheet section.

4. The method recited in claim 3 further comprising the step of: welding upper plate members and lower plate members respectively to adjacent upper plate members and lower plate members lying in the same plane to complete a tube support sheet.

5. The method recited in claim 2 further comprising:

rotating each tube module from the horizontal to the vertical prior to the hanging of the tube module.

* * * * *